United States Patent [19]

Fletchall

[11] 4,162,059

[45] Jul. 24, 1979

[54] PORTABLE WINCH

[76] Inventor: Cleo L. Fletchall, 4526 Maria Ave., NE., Salem, Oreg. 97303

[21] Appl. No.: 828,298

[22] Filed: Aug. 29, 1977

[51] Int. Cl.[2] ..... B66D 3/18

[52] U.S. Cl. ..... 254/187.4; 254/186 R

[58] Field of Search ..... 254/175.7, 186 R, 187.1, 254/187.8, 187.4; 242/117; 74/228

[56] References Cited

U.S. PATENT DOCUMENTS

| | | | |
|---|---|---|---|
| 901,719 | 10/1908 | Mason | 242/117 |
| 2,044,447 | 6/1936 | Rice | 254/186 R |
| 2,563,089 | 8/1951 | Wilson | 254/187.1 |
| 2,869,822 | 1/1959 | Shurtliff | 254/187.8 X |
| 2,930,585 | 3/1960 | Reeves | 254/186 R |
| 3,322,398 | 5/1967 | Smith | 254/186 R |
| 3,563,196 | 2/1971 | Nicolay | 74/228 X |
| 3,938,781 | 2/1976 | Craven et al. | 254/175.7 |

*Primary Examiner*—Trygve M. Blix
*Assistant Examiner*—Winston H. Douglas
*Attorney, Agent, or Firm*—Lee R. Schermerhorn

[57] ABSTRACT

The winch is driven by a chain saw motor through a compact and light weight chain and sprocket transmission. The transmission includes a jaw type clutch and the winch drum is provided with a hand brake. The winch drum is specially designed to facilitate the even spooling of a nylon line. A retractable dog engages a support for the winch to anchor the device against the tension exerted on the line.

7 Claims, 3 Drawing Figures

PORTABLE WINCH

BACKGROUND OF THE INVENTION

This invention relates to a portable winch driven by a chain saw motor.

In cleaning up the debris after a logging operation, and for many other purposes, there is a need for a portable winch which may be hand carried to the work site. To be practical for such purposes the winch must be compact and light in weight, of ample power, safe and reliable in operation and economical to manufacture.

The objects of the present invention are to provide an improved portable winch driven by a chain saw motor, to provide an improved chain and sprocket winch transmission having improved chain tightening means and having a positive jaw type clutch and to provide a specially designed winch drum to facilitate the even spooling of a nylon line.

SUMMARY OF THE INVENTION

The saw bar on a chain saw motor is replaced by an adapter bar which guides a driving chain from the motor. The driving chain is similar to a saw chain but has no cutting teeth. The adapter bar is bolted to an adjustable bracket on the frame of the winch. Also mounted on the adjustable bracket are two sprocket shafts in a chain and sprocket transmission and a positive jaw type clutch to disconnect the winch drum from the transmission.

The winch drum is provided with a hand brake and is specially designed to facilitate the even spooling of a light weight nylon line. Other features include a carrying handle and a retractable dog to engage a stump or other support on which the winch is placed, to anchor the device against the pull on the line.

The invention will be better understood and additional objects and advantages will become apparent from the following description of the preferred embodiment illustrated in the accompanying drawings. Various changes may be made in the details of construction and arrangement of parts and certain features may be used without others. All such modifications within the scope of the appended claims are included in the invention.

DESCRIPTION OF THE PREFERRED EMBODIMENT

Figure 1:
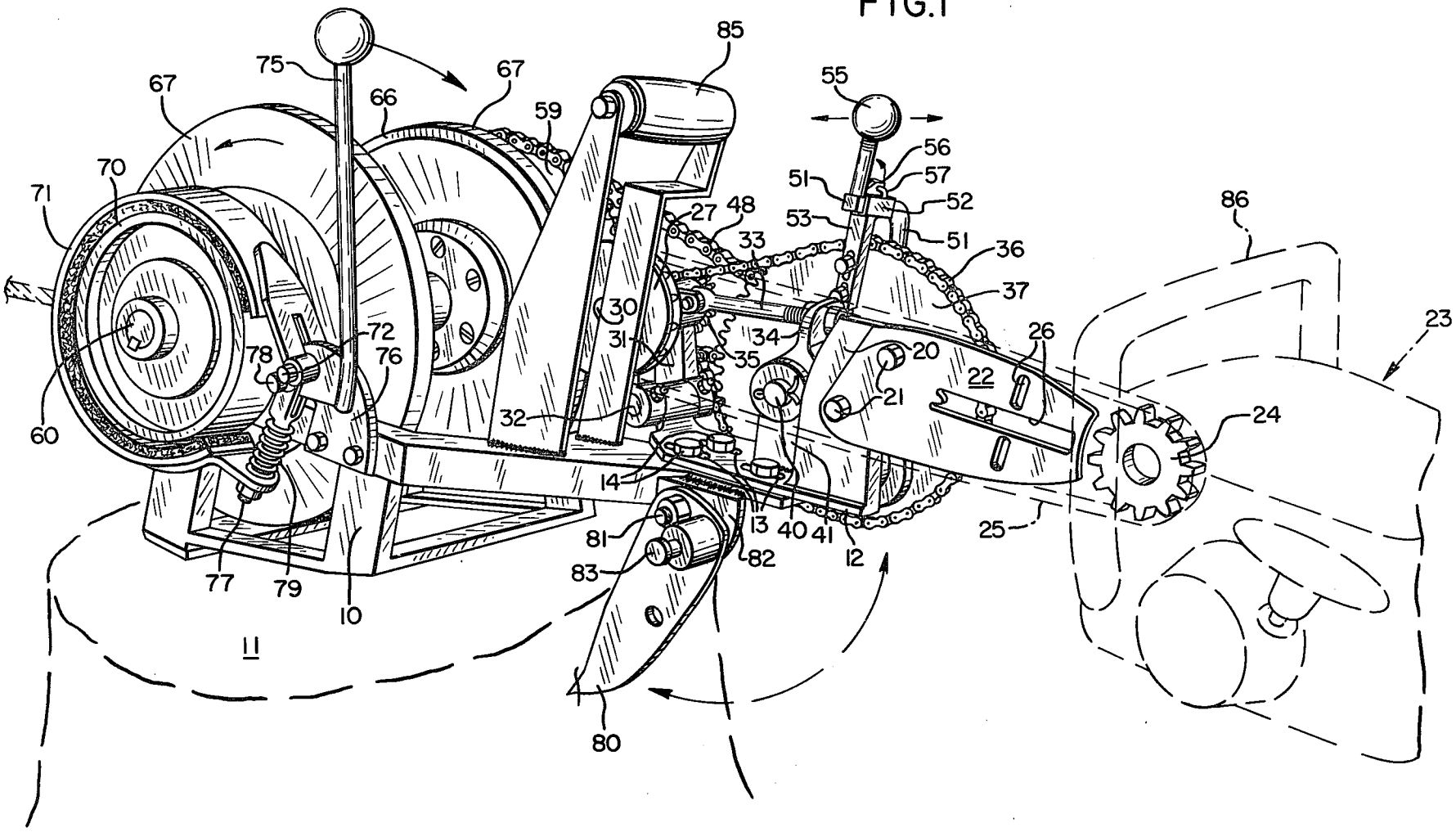
FIG. 1 is a perspective view of a winch embodying the invention.
Figure 2:
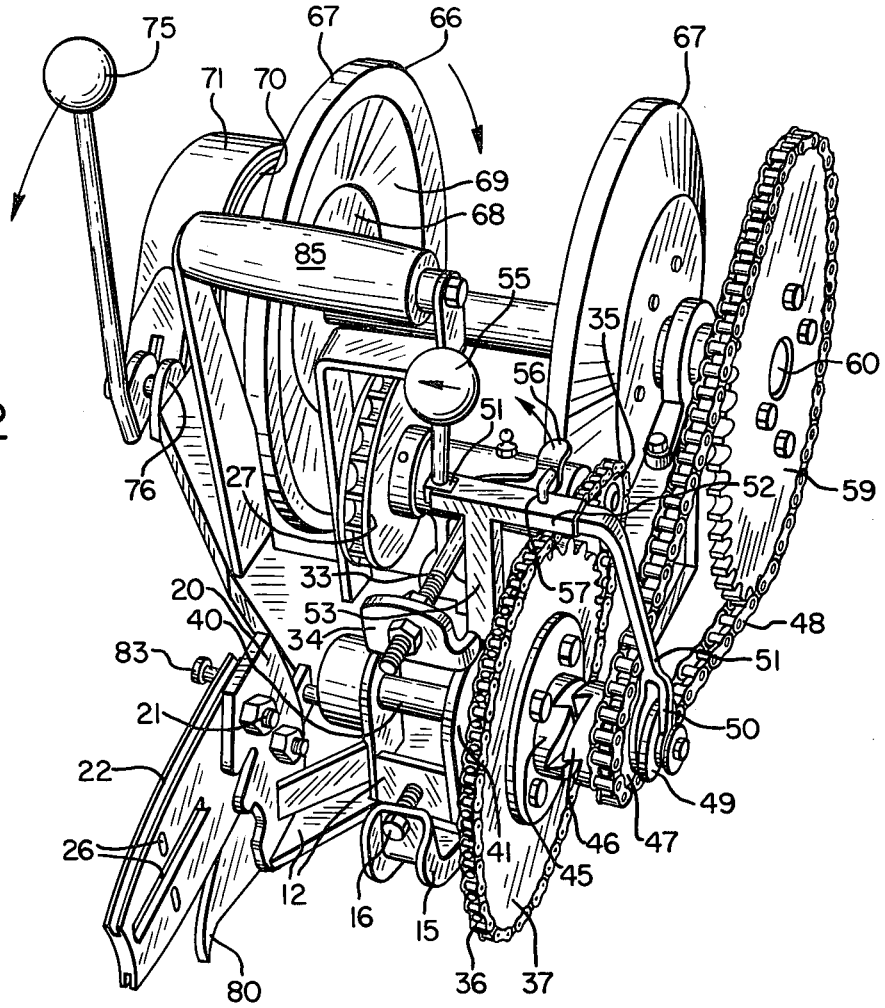
FIG. 2 is a perspective view of the opposite side of the winch.

In FIG. 1 the frame 10 is adapted to rest on a stump 11 or other suitable support. A bracket 12 has slots 13 to receive bolts 14 for longitudinal adjustment of the bracket on the rear end of frame 10. As seen in FIG. 2 an upturned ear 15 on the rear end of frame 10 receives a bolt 16 to maintain the adjusted position of bracket 12.

An upstanding plate 20 on the rear end of bracket 12 receives bolts 21 in an adapter bar 22 on a conventional chain saw motor 23. Motor 23 rotates a sprocket 24 for a drive chain 25 which is guided by adapter bar 22. Drive chain 25 operates the same as a saw chain on sprocket 24 and adapter bar 22 but is without cutting teeth. As in a conventional saw bar the adapter bar 22 is provided with slots 26 for conventional chain tightening means (not shown) provided on chain saws.

Chain 25 drives a sprocket 27 keyed on one end of a first shaft 30 which is mounted for rotation in a bearing on the upper end of an arm 31. The lower end of arm 31 is pivotally mounted at 32 on the front end of bracket 12. The position of shaft 30 and arm 31 is determined by an adjustable link 33 connected with a lug 34 on bracket 12.

As seen in FIG. 2 the opposite end of shaft 30 is keyed to a sprocket 35 for a second chain 36 which drives a sprocket 37. Sprocket 37 is fixed on a second shaft 40. The previously mentioned lug 34 is part of an upright 41 on bracket 12 which includes a bearing supporting shaft 40. Sprocket 37 carries one element 45 of a jaw clutch which has a mating element 46 on a clutch sprocket 47 for a chain 48. Also intergral with sprocket 47, and spaced outwardly therefrom, in a disc 49, the sprocket 47 with its clutch element 46 and disc 49 being rotatable and axially slidable on shaft 40.

Clutch element 46 is shifted axially for engagement or disengagement relative to clutch element 45 by a fork 50 which straddles the disc 49. Fork 50 is on the lower end of an arm 51 having a horizontal upper end which slides in a square guide tube 52. Guide tube 52 is mounted on the upper end of an extension 53 on upright 41. The clutch is manipulated by a handle 55 on the horizontal end of arm 51 which slides in guide tube 52.

Chain 48 normally holds clutch element 46 engaged with clutch element 45. The clutch may be held in disengaged position as shown in FIG. 2 by a pivotal hand lever 56 which has a pin 57 to enter openings in arm 51 and guide tube 52 and prevent sliding movement of the arm in the guide tube. Chain 48 drives winch drum sprocket 59 keyed on winch drum shaft 60 which is mounted for rotation in bearings on the front end of frame 10. Clutch sprocket 47 is aligned with sprocket 59 when the clutch is engaged. Disengaging the clutch shifts sprocket 47 slightly out of alignment with sprocket 59.

Figure 3:
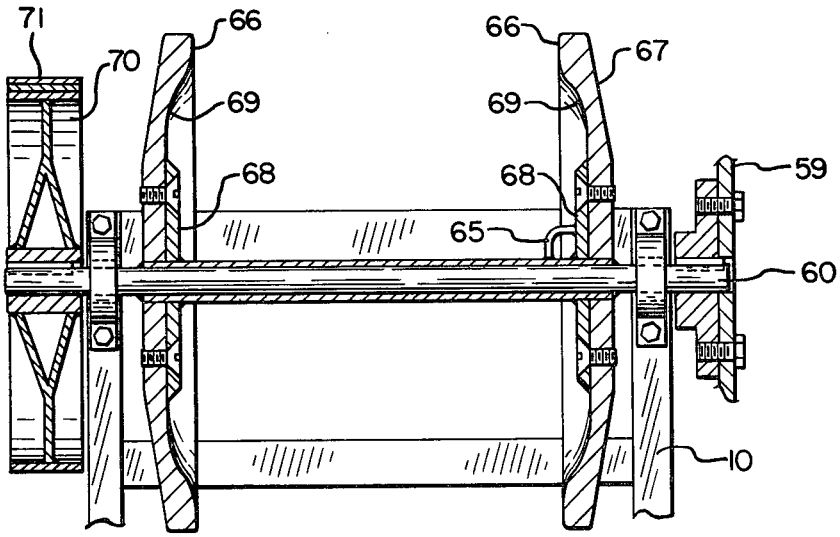
FIG. 3 is a vertical sectional view of the winch drum.

In order to reduce weight as much as possible it is preferred to use a nylon rope for a winch line, one end being tied to the eye 65 in FIG. 3. Nylon rope has heretofore presented a spooling problem on conventional winch drums in that it tends to pile up at the ends of the drum and not reverse direction promptly to wind in even layers as does a wire cable.

It is found that this difficulty may be corrected by providing inturned peripheral guide flanges 66 on the spool and discs 67. Each flange 66 projects inwardly in an axial direction beyond the planes of inside disc surfaces 68 and 69 causing the rope to reverse promptly at the ends of the drum and wind in even layers, often referred to as level winding. This feature makes it possible to use a nylon rope and thereby save a considerable amount of weight.

Keyed on one end of winch drum shaft 60 is a brake drum 70 which is wrapped by a brake band 71. The upper end of brake band 71 is anchored to pivot pin 72 for brake handle 75. Pin 72 is supported by an ear 76 on frame 10. The lower end of brake band 71 is tightened by a clevis bolt 77 pivotally connected to a pin 78 in the front end of the brake lever. Compression spring 79 insures the release of the brake band from drum 70 when handle lever 75 is released.

A retractable dog 80 engages the back side of stump 11 to resist the tension applied to the winch line. The dog 80 comprises an arm mounted on a pivot bolt 81 in an ear 82 on the rear end of frame 10. Dog 80 is held in operative position as shown in FIG. 1 by a spring actuated lock pin 83 which enters a hole in ear 82. When lock pin 83 is withdrawn, the dog 80 may be rotated counter-clockwise to an inoperative position. Dog 80 is shown in retracted position in FIG. 2.

Frame 10 is provided with a carrying handle 85. When the chain saw motor 23 is assembled on the winch as shown in FIG. 1 the assembled device may be carried by two people, one holding the winch handle 85 and the other holding the carrying handle 86 on the motor. When the motor is removed from the winch one person may carry both parts, holding the handle 85 in one hand and the handle 86 in the other hand for a balanced load.

Thus, with its ability to use nylon rope an unusually lightweight winch is achieved, the simple gear and sprocket transmission making a very compact unit for the greatest convenience in carrying it to the work site.

Another important advantage of the present arrangement is the facility of adjusting the several chains. Chain 48 is tightened by adjusting bracket 12 on frame 10 by means of bolts 14 and 16. Tightening bolt 16 draws the chain 48 tight. Chain 36 is tightened by adjustable link 33. Drive chain 25 is tightened by the conventional means provided on chain saws involving the slots 26 in adapter bar 22 as mentioned. There is a separate adjustment for each chain and no one adjustment affects any other chain.

Jaw clutch 45, 46 provides positive disengagement of the winch drum from the motor for safety. Chain saw motors are usually equipped with an automatic centrifugal clutch which is speed responsive. If the motor is accelerated for warm up or any other purpose the centrifugal clutch engages automatically. The present manual clutch 45, 46 prevents rotation of the winch drum when such operation is not desired. Clutch 45, 46 also substantially eliminates transmission friction when the rotation of the winch drum is reversed by pulling out line. In this operation only the chain 48 and sprocket 47 must be rotated by the effort of the workman, making it easy to pull the line out.

What is claimed is:

1. A portable winch comprising a frame adapted to rest on a support, said frame extending lengthwise horizontally and having a front end and a rear end, a bracket mounted on said rear end of said frame, an upstanding vertical plate on said bracket having bolt holes for connection with one end of an adapter bar on a chain saw motor, said adapter bar guiding a drive chain driven by said motor, a first transverse shaft mounted on a pivotal arm on said bracket, an adjustable link connected between said arm and said bracket, a driven sprocket on said first shaft driven by said drive chain, a second transverse shaft mounted on said bracket rearward from said first shaft, a first sprocket on said second shaft driven by a second chain on a second sprocket on said first shaft, a clutch sprocket on said second shaft having a jaw clutch connection with said first sprocket on said second shaft, a clutch handle for shifting said clutch sprocket axially on said second shaft to engage and disengage said clutch, a transverse winch drum shaft mounted on the front end of said frame forward from said first shaft, a sprocket on said winch drum shaft driven by a third chain from said clutch sprocket, a hand brake on said winch drum shaft, and means to adjust said bracket lengthwise on said frame to tighten said third chain, said adjustable link serving to tighten said second chain, and said adapter bar and chain saw motor having means to tighten said drive chain.

2. A winch as defined in claim 1 including a retractable dog arm arranged to engage said support and anchor the winch against the pulling force exerted by a line on said winch drum.

3. A winch as defined in claim 2, said dog arm comprising an arm mounted on said rear end of said frame for pivotal movement between a downwardly extending position in engagement with said support and a raised retracted position, and means to lock said arm in said downward position.

4. A winch as defined in claim 1, said clutch handle being slidable parallel with said second shaft and including a fork for sliding said clutch sprocket on said second shaft, and means for locking said handle and fork in clutch disengaged position.

5. A winch as defined in claim 1 including a carrying handle on said frame.

6. A winch as defined in claim 1 including a pair of spool end discs defining a winch drum on said winch drum shaft, said discs having peripheral axial flanges confronting each other to assist the spooling of a line in even layers between the discs.

7. A portable winch comprising a frame adapted to rest on a support, said frame extending lengthwise horizontally and having a front end and a rear end, a bracket mounted on said rear end of said frame, an upstanding vertical plate on said bracket having bolt holes for connection with one end of an adapter bar on a chain saw motor, said adapter bar guiding a drive chain driven by said motor, a first transverse shaft mounted on a pivotal arm on the forward end of said bracket, a driven sprocket on said first shaft driven by said drive chain, a second transverse shaft mounted on an upright on said bracket rearward from said first shaft, a first sprocket on said second shaft driven by a second chain on a second sprocket on said first shaft, an adjustable link connected between said arm and a lug on said upright to tighten said second chain, a clutch sprocket on said second shaft having a jaw clutch connection with said first sprocket on said second shaft, a clutch handle for shifting said clutch sprocket axially on said second shaft to engage and disengage said clutch, a transverse winch drum shaft mounted on the front end of said frame forward from said first shaft, a sprocket on said winch drum shaft driven by a third chain from said clutch sprocket, means to adjust said bracket lengthwise on said frame to tighten said third chain, said adapter bar and chain saw motor having means to tighten said drive chain, a hand brake on said winch drum shaft, a pair of spool end discs defining a winch drum on said winch drum shaft, said discs having peripherial axial flanges confronting each other to assist the spooling of a line in even layers between the discs, a retractable dog arm arranged to engage said support and anchor the winch againt the pulling force exerted by a line on said winch drum, said dog arm comprising an arm mounted on said rear end of said frame for pivotal movement between a downwardly extending position in engagement with said support and a raised retracted position, means to lock said arm in said downward position, and a carrying handle on said frame.

* * * * *